US005287966A

United States Patent [19]

Stahl

[11] Patent Number: 5,287,966

[45] Date of Patent: Feb. 22, 1994

[54] SLIDE ON MULTI-LEVEL BASKET

[75] Inventor: Edward L. Stahl, Orlando, Fla.

[73] Assignee: Piper Industries of Texas, Inc., Garland, Tex.

[21] Appl. No.: 950,005

[22] Filed: Sep. 24, 1992

Related U.S. Application Data

[63] Continuation-in-part of Ser. No. 815,866, Jan. 3, 1992, abandoned, which is a continuation of Ser. No. 525,859, May 21, 1990, abandoned, which is a continuation-in-part of Ser. No. 402,684, Sep. 5, 1989, Pat. No. 5,035,326.

[51] Int. Cl.[5] ..... B65D 21/04

[52] U.S. Cl. ..... 206/509; 206/503; 206/507; 206/519

[58] Field of Search ..... 206/507, 505, 503, 509, 206/514, 511, 518, 519, 821, 386, 595; 220/600

[56] References Cited

U.S. PATENT DOCUMENTS

| | | | |
|---|---|---|---|
| 4,000,817 | 1/1977 | Saunders et al. | 206/505 |
| 4,093,070 | 6/1978 | Stahl | 206/507 |
| 4,093,071 | 6/1978 | Stahl et al. | 206/507 |
| 4,106,624 | 8/1978 | Thurman | 206/507 |
| 4,189,052 | 2/1980 | Carroll et al. | 206/507 |
| 4,211,327 | 7/1980 | Stahl et al. | 206/505 |
| 4,426,001 | 1/1984 | Stahl et al. | 206/507 |

*Primary Examiner*—Allan N. Shoap
*Assistant Examiner*—S. Castellano
*Attorney, Agent, or Firm*—Mason, Fenwick & Lawrence

[57] ABSTRACT

A slide-on multi-level basket useful for storing and transporting baked goods is provided which includes a floor and a pair of upstanding side walls configured for stacking identical baskets at three different levels and presenting structure enabling other, identical baskets to slide thereon into stacked or nested orientations. A multi-level basket hereof includes a slideway or rail extending along each of the side walls, the side walls being divided into inner and outer panels. Each basket includes a thin web and a wide web spaced apart and respectively proximate a front end wall and a rear end wall. The thick and thin webs are complimentarily configured with a relieved portion and a slot in each of the side walls whereby the webs can slide along the rail of a next lower, identical basket enabling the upper basket to drop into either a nested or stacked relationship according to the relative orientation of the two baskets, when superposed over the next lower, identical basket.

20 Claims, 6 Drawing Sheets

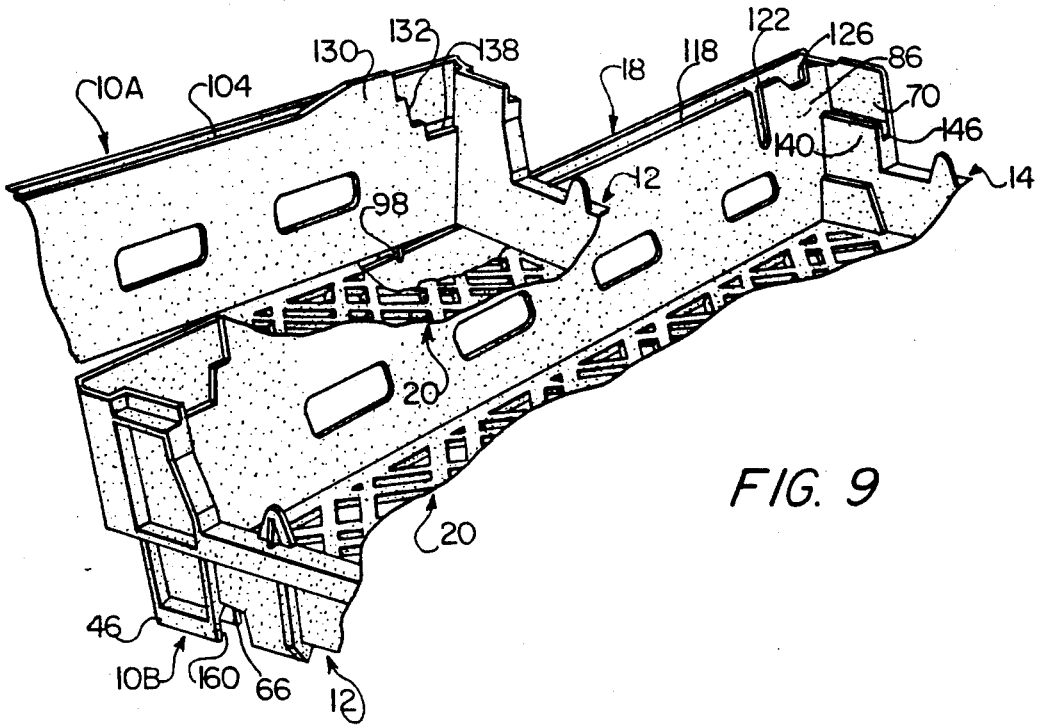
FIG. 9
FIG. 10
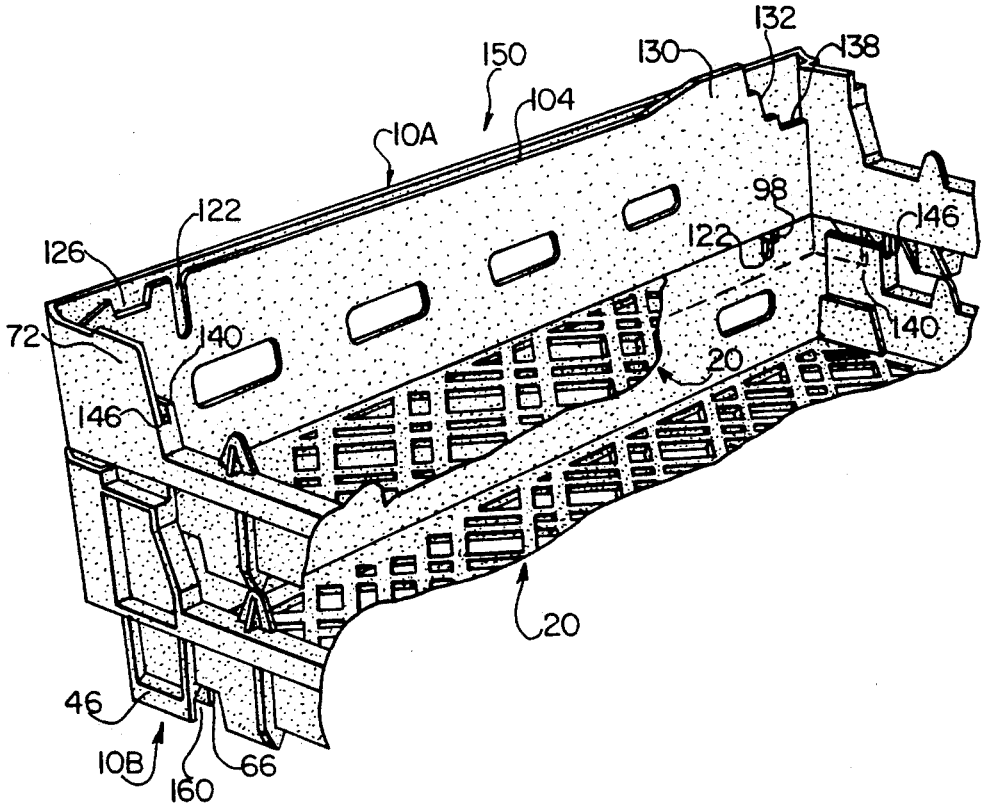

SLIDE ON MULTI-LEVEL BASKET

This application is a continuation-in-part of application Ser. No. 07/815,866, filed Jan. 3, 1992 and entitled Slide-On Multi-Level Basket, now abandoned, which is a continuation of application Ser. No. 07/525,859 filed May 21, 1990 and entitled Slide-On Multi-Level Basket, now abandoned, which is a continuation in-part of Ser. No. 07/402,684, filed Sep. 5,1989now U.S. Pat. No. 5,035,326, the contents of these applications being hereby incorporated by reference.

BACKGROUND OF THE INVENTION

1. Field of the Invention

This invention concerns a slide-on multi-level basket especially useful for stacking or nesting at alternate heights for storing baked goods such as cake, buns, and bread loaves therein. The slide-on multi-level basket hereof is advantageously configured to receive a second, complimentarily configured basket thereon; enabling the second basket to slide onto the first basket so that the two can be stacked at a first or second level in superposed relationship.

2. Description of the Prior Art

It is now well-known in the operation of bakeries to provide a rigid supporting container or basket to protect baked goods from damage incident to handling and transport thereof. In most recent years, bakeries have produced a variety of different baked goods, such as loaves, cakes, and hamburger buns. Each of these products is conventionally produced in different product heights, resulting in the need to economically protect those goods while avoiding the necessity for having different baskets for each product.

As a result, there have been developed a number of different multi-level stacking baskets which are advantageously designed to stack or nest at different levels according to the height of the product contained therein. For example, a second basket could be superposed over a first basket at a first, lower level for hamburger buns, and at a second, upper level for loaves of bread. The availability of multi-level baskets has reduced the need for an increased inventory of specialty baskets for each product. Examples of different stacking baskets include those shown in the following: U.S. Pat. No. 3,387,740 to Bockenstette; U.S. Pat. No. 3,420,402 to Frater et al.; U.S. Pat. No. 3,392,875 to Bockenstette; U.S. Pat. No. 4,093,070 to Stahl; U.S. Pat. No. 4,106,623 to Carroll et al.; U.S. Pat. No. 4,106,624 to Thurman; U.S. Pat. No. 4,106,625 to Carroll et al.; U.S. Pat. No. 4,189,052 to Carroll et al.; U.S. Pat. No. 4,211,327 to Stahl et al.; U.S. Pat. No. 4,320,837 to Carroll et al.; U.S. Pat. No. 4,440,302 to Ehrman et al.; U.S. Pat. No. 4,426,001 to Stahl et al.; U.S. Pat. No. 4,520,928 to Wilson; U.S. Pat. No. 4,523,681 to Kreeger; U.S. Pat. No. 4,600,103 to Tabler; U.S. Pat. No. 4,601,393 to Veenman et al.; U.S. Pat. No. 4,619,366 to Kreeger; U.S. Pat. No. 4,643,310 to Deaton et al.; and U.S. Pat. No. 4,759,451 to Apps.

However, a difficulty inherent in those baskets able to nest or stack at alternate levels was their inability to alternately stack or nest without aligning the upper basket directly over the lower basket. Oftentimes, the baskets' configuration required that the user place the second basket immediately over the first basket for them to stack or nest. This presents a huge problem in practice, as stacks of baskets may often reach six to eight feet in height. Stacking or unstacking the baskets has proved difficult, especially for shorter people handling very tall stacks. It is to the solution of this and other problems to which the present invention is directed.

SUMMARY OF THE INVENTION

These problems have largely been overcome by the slide-on multi-level basket of the present invention which enables a second basket to slide onto the first before dropping into either of its two stacked positions. Advantageously, the present invention preserves the desirable features of nesting at different levels for different products, as well as enabling positioning of the baskets in a third orientation for storage when the baskets are empty.

The slide-on multi-level basket of the present invention broadly includes a floor and a pair of spaced-apart side walls which are mirror images of one another and include an outer panel and an inner panel. The side walls are constructed for stacking a second identical basket thereon at alternately a first or a second level, and include a top edge or margin on the inner and outer panels. The top edge or margin of each inner panel extends a majority of the length of the side wall. The top edge or margin of the inner panel presents a slideway bounded by a slot at one end and ramp terminating in a recess at the other end. ****A first stacking post defining a relatively wide foot is located generally beneath the slot while a second stacking post defining a relatively thin foot is located beneath the recess.** The feet are positioned to slide along the top edge or margin of the inner panel with the wide foot sized for bridging the slot and sliding thereover, while the thin foot is engaged by the slot and thus shifts downwardly therein. Two identical baskets stack at one level when in a common orientation, while configured for sliding and nesting at a second level when one of the baskets is rotated 180 degrees relative to the other.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIG. 9 is a fragmentary perspective view of two multi-level baskets similar to FIG. 7 but with the upper basket rotated 180 degrees to the lower basket in preparation for positioning in nested engagement; and FIG. 10 is a fragmentary perspective view of two multi-level baskets similar to FIG. 9, but with the upper basket fully advanced along the upper slideway or rail of the lower basket and aligned in a nested, superposed relationship.

DETAILED DESCRIPTION OF THE PREFERRED EMBODIMENTS

Figure 1:
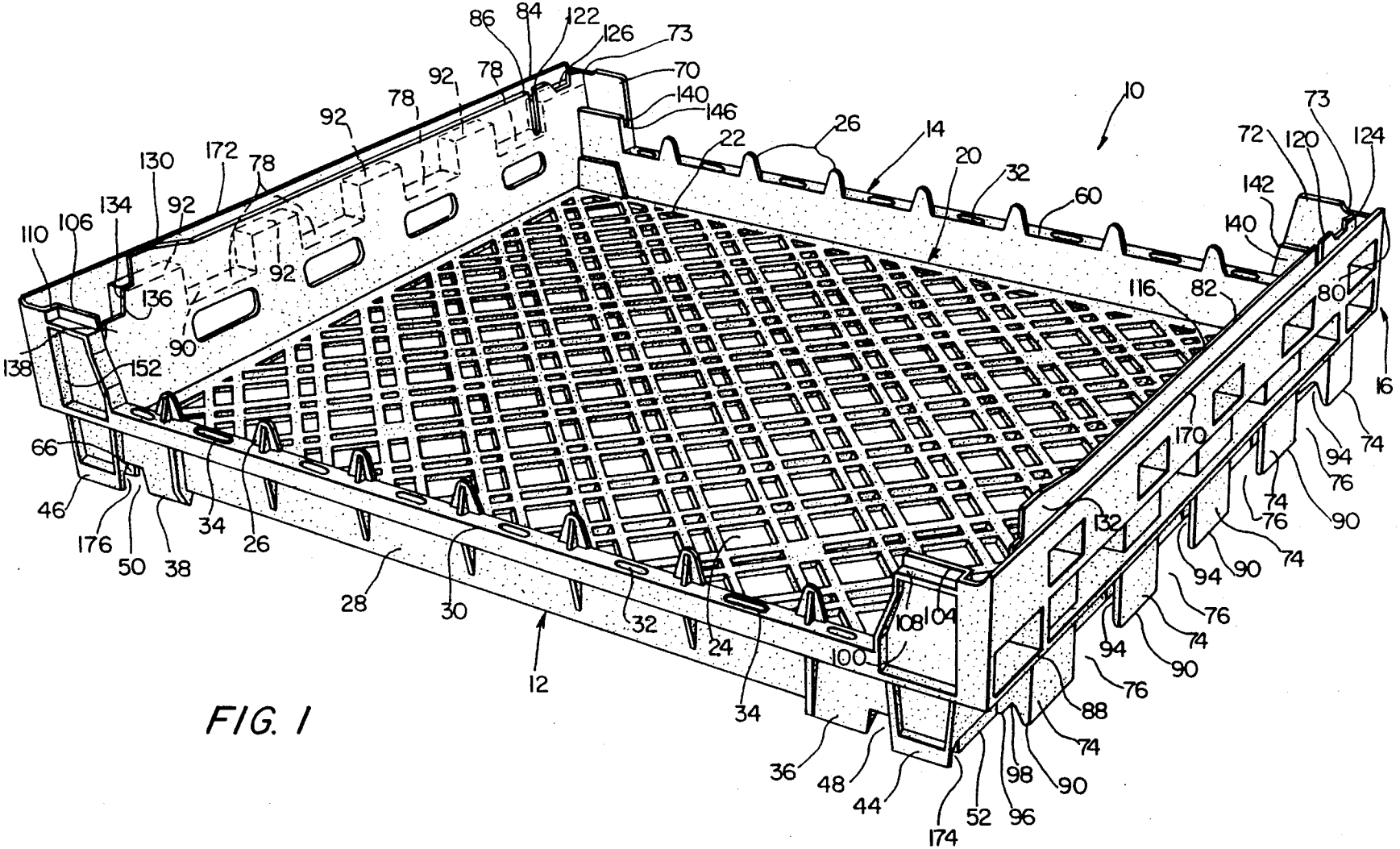
FIG. 1 is a perspective view of the slide-on multi-level basket of the present invention, with nesting ledges and stacking platforms located between an inner panel and outer panel of each side wall as shown in phantom.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring now to the drawings, a multi-level basket 10 as shown in FIG. 1 broadly includes a front end wall 12, a rear end wall 14, a right side wall 16, a left side wall 18 and a floor 20. The right side wall 16 and left side wall 18 are substantially mirror images of one another, whereby similarly configured baskets may be placed on basket 10 in different orientations to enable alternative high-level stacking or nesting. The basket 10 hereof can advantageously be constructed by injecting molding whereby the entire basket 10 may be formed as a unitary article from a synthetic resin such as polyethylene.

In greater detail, floor 20 includes a series of selectively spaced ribs 22 to define uniformly spaced openings 24 therebetween. The openings 24 ar spaced at preselected intervals which correspond to the spacing of teeth 26 projecting upwardly from the front end wall 12 and rear end wall 14. The teeth 26 inhibit spillage of baked products from the basket 10 and interfit through the openings 24 in the floor 20 of the similarly configured basket when placed in a storage orientation at 90° to one another.

Front end wall 12 includes a lower wall portion 28 terminating in a cornice 30. Cornice 30 is of somewhat greater width than wall portion 28. Cornice 30 is provided with a plurality of spaced slits 32 for receiving therein an insert 34, preferably of a contrasting color to the remainder of multi-level basket 10 and for use as a marker in visually identifying which portion of the basket is front end wall 12. The insert 34 is preferably of a snap-lock type having outwardly projecting jaws which yield as the insert is pressed into slit 32. As the insert 34 is fully seated, the jaws spring outwardly to their normal position and thus lock the insert 34 in slit 32. Rear end wall 14 is similarly provided with a plurality of slits 32 therein in the event it is desired to place inserts 34 in the rear end wall 14 rather than the front end wall 12. Preferably, the insert 34 is formed of a light colored resilient synthetic resin such as polyethylene when the basket 10 is formed of a brown or black synthetic resin, but in any event is of a contrasting color to the remainder of the basket 10.

Figure 4:
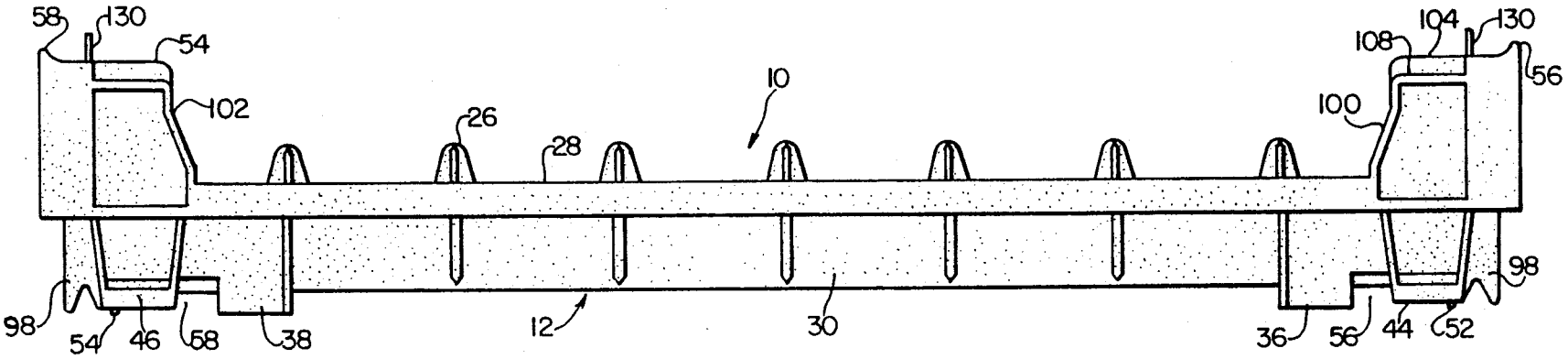
FIG. 4 is a front elevational view of the multi-level basket shown in FIG. 1.
Figure 5:
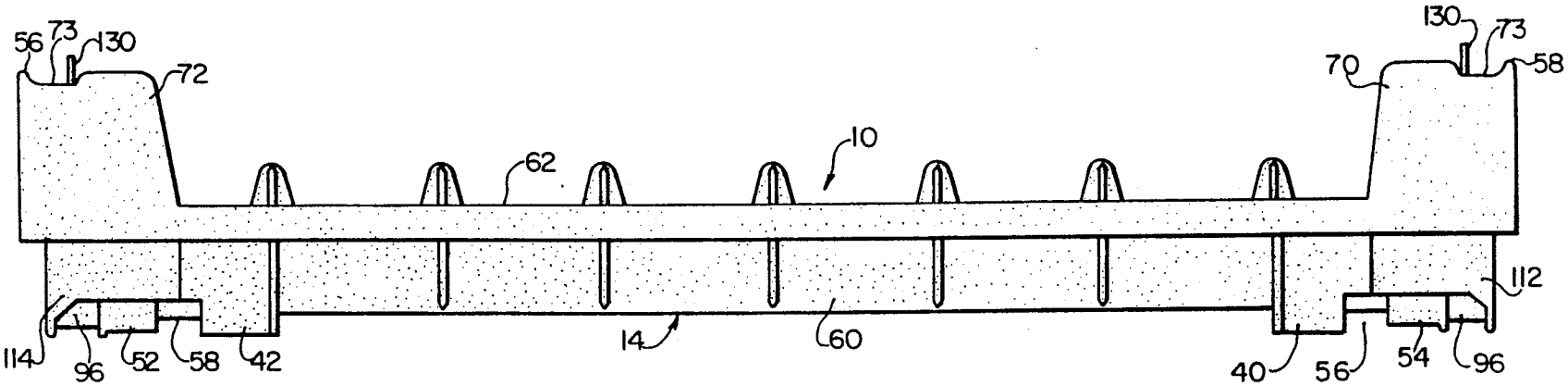
FIG. 5 is a rear elevational view of the multi-level basket shown in FIG. 1.

As better seen in FIGS. 4 and 5, front end wall 12 includes a pair of spaced-apart, downwardly-extending registry legs 36 and 38, and rear end wall 14 includes a pair of spaced-apart, downwardly-extending registry legs 40 and 42. Referring to FIG. 4, front end wall 12 also includes stacking toes 44 and 46 adjacent to and outwardly of registry legs 36 and 38. As can be seen from FIG. 4, both registry legs 36 and 38 and stacking toes 44 and 46 project downwardly with respect to the remainder of front end wall 12 to define a front right recess 48 between registry leg 36 and stacking toe 44 and a front left 50 between registry leg 38 and stacking toe 46. Stacking toes 44 and 46 terminate upwardly of registry legs 36 and 38, so that when basket 10 is based on a substantially planar, horizontal surface resting on registry legs 36, 38, 40, and 42, stacking toes 44 and 46 are spaced upwardly of the surface.

Figure 2:
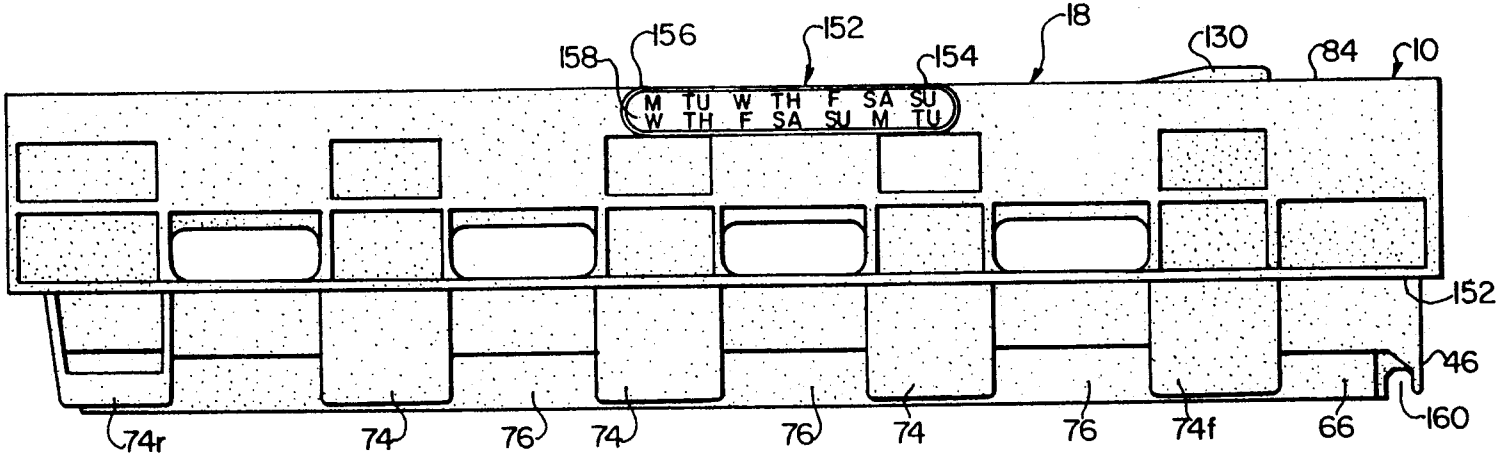
FIG. 2 is a left side elevational view of the multi-level basket shown in FIG. 1.
Figure 3:
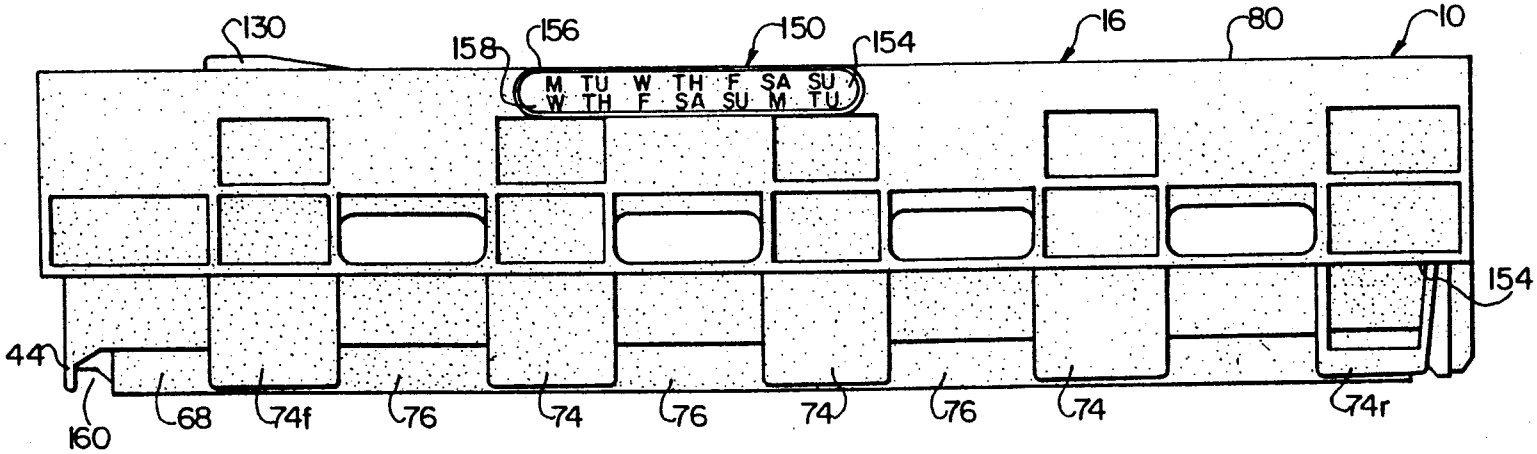
FIG. 3 is a right side elevational view of the multi-level basket and which is a mirror image of the left side elevational view of FIG. 2.

As can be seen in FIGS. 4 and 5, and also in FIGS. 2 and 3, lower runners 52 and 54 extend rearwardly from stacking toes 44 and 46, respectively. Lower runner 52 and lower runner 54 extend longitudinally from front to rear along basket 10 parallel to right and left side walls 16 and 18, and depend downwardly from floor 20 to a position in alignment with registry legs 36, 38, 40, and 42, whereby lower runners 52 and 54 extend beneath all other portions of the basket 10, except registry legs 36, 38, 40, and 42. Thus, when based on a substantially planar, horizontal surface, basket 10 is supported exclusively by runners 52 and 54 on the sides, and by registry legs 36, 38, 40, and 42 at the front and rear.

Turning now to FIG. 5, rear end wall 14 also includes a lower wall portion 60 terminating in a cornice 62. Cornice 62 has a width the same as cornice 30. Registry legs 40 and 42 define with lower runners 54 and 52 a rear right recess 56 between registry leg 40 and lower runner 54 and a rear left recess 58 between registry leg 42 and lower runner 52. The widths of cornice 30 and cornice 62 ar complementary to right and left recesses 48 and 50 in front end wall 12 and to right and left recesses 56 and 58 in rear end wall 14. Lower runner 52 and lower runner 54 both include, at either end, a transverse wall which extends a short distance, as can be seen in FIG. 5, to thereby define front right and left recesses 48 and 50 as well as rear right and left recesses 56 and 58.

Rear end wall 14 also includes right retaining buttress 70 and left retaining buttress 72 which extend above cornice 62 along the rear end wall 14. Retaining buttresses 70 and 72 both include a notch 73. Notches 73 extend transversely from left outer panel 84 to a position inward of left inner panel 86, and from right outer panel 80 to a position inward of right inner panel 82. Notches 73 provide a sliding surface for lower runners 52.

Turning now to FIGS. 2 and 3, side walls 16 and 18 each include a plurality of spaced-apart stacking posts 74. Each of the stacking posts 74 is of a common width and height, to present a plurality of equally spaced breaches 76 therebetween. Each of these breaches 76 is of somewhat greater width than the width of the adjacent stacking post 74, the width of each breach corresponding to the width of a corresponding nesting ledge 78 located immediately thereabove and in side walls 16 and 18 as shown in phantom in FIG. 1. The spacing between stacking posts 74 and lower runners 52 and 54 is such that left stacking posts 74 and lower runner 52 can be received simultaneously in one of notches 73, while right stacking posts 74 and lower runner 54 can be received simultaneously in the other of notches 73, to facilitate sliding of one basket 10 onto a lower basket.

Right side wall 16 and left side wall 18 each include spaced-apart inner and outer panels. As best seen in FIG. 1, right side wall 16 includes right outer panel 80 and right inner panel 82, while left side wall 18 includes right outer panel 84 and left inner panel 86. Outer panels 80 and 84 each have top and bottom edges, the bottom edges being upwardly offset from floor 20. Inner panels 82 and 86 also each have top and bottom edges, the bottom edges conjoining floor 20.

Horizontal ridges 88 and 90 respectively connect the bottom edges of outer panels 80 and 84 with inner panels 82 and 86. A plurality of spaced-apart horizontal stacking platforms 92 are formed between right outer and inner panels 80 and 82 and between left outer and inner panels 84 and 86. Ridges 88 and 90 define nesting ledges 78 alternating between platforms 92. Stacking platforms 92 are narrower than nesting ledges 78. Nesting ledges 78 and stacking platforms 92 are located between each respective outer panel 80 and 84 and the respective inner panel 82 or 86. As can be seen in FIG. 1, nesting ledges 78 and stacking platforms 92 are positioned intermediate outer panel 84 and inner panel 86 of left side wall 18, and it is to be understood that nesting ledges 78 are correspondingly located between outer panel 80 and inner panel 82 of right side wall 16.

Stacking posts 74 extend downwardly from ridges 88 and 90 in vertical alignment with stacking platforms 92. Stacking posts 74 are thus of a width to fit on nesting ledges 78 when the basket 10 is placed on a similar basket at the nested elevation. In addition, stacking posts 74 correspond substantially in width to stacking platforms 92 whereby stacking posts 74 can rest upon the stacking platforms 92 of a similarly configured basket or stacking configuration.

Yet further, stacking posts 74 are parallel to and offset from inner panels 82 and 86, and the distance between outer panel 80 and inner panel 82, and also outer panel 84 and inner panel 86, is sufficient to accommodate stacking posts 74 therewithin so that stacking posts 74 can rest on either stacking platforms 92 or nesting ledges 78 according to the relative orientation of two superposed baskets 10. The bottom edges of stacking posts 74 are separated by a space 94 from the corresponding base 52 or 54. The space 94 extends upwardly a sufficient distance to permit the inner wall 82 or 86 of a similarly configured basket 10 positioned therebelow to lie therewithin and thus stacking posts 74 can rest directly upon either stacking platform 92 or nesting ledge 78 without interference from inner panel 82 or 86.

The rearmost stacking posts **74*r* on left and right side walls 14 and 16 are provided with relatively thick webs 96 extending inwardly from stacking posts 74*r* to inner panels 82 and 86, as shown in FIG. 5. It is to be understood that a thick web 96 is located along left side wall 16 in a mirror image of FIG. 7, and interconnects stacking post 74*r* with inner panel 82. In addition, a relatively thin web 98 is located adjacent forwardmost stacking posts 74*f* and interconnects stacking posts 74*f* with inner panels 82 and 86. Again, it is to be understood that thin web 98, visible in FIGS. 1, 4, and 9, is located along left side wall 16 in a mirror image of FIG. 9, and interconnects stacking post 74*f* with left inner panel 82 and base 52**.

Front end wall 12 also includes right and left outboard portions 100 and 102 extending upwardly from the ends of cornice 30. Stacking lugs 104 and 106 extending upwardly from the inner edges of outboard portions 100 and 102 define stacking shelves 108 and 110 outboard of stacking lugs 104 and 106, respectively. Stacking lugs 104 and 106 are elevated with respect to the cornice 30 and the remainder of front end wall 12. On the other hand, stacking lugs 104 and 106 are lower in elevation than the upper margins or edges of right and left outer panels 80 and 84 of right and left side walls 16 and 18, respectively.

The stacking shelves 104 and 106 are positioned to support the stacking toes 44 and 46 of an identical basket 10 superposed onto the basket 10 hereof when both are in a common orientation for positioning in a stacked orientation. As can be seen in FIG. 5, rear end wall 14 includes left and right recess portions 112 and 114 which are located below and spaced inwardly relative to retaining buttresses 70 and 72, as well as cornice 62. Thus, when basket 10 is superposed in a nested orientation on an identical basket, left recess portion 112 and right recess portion 114 are located interior to abutting outboard portions 102 and 100, respectively, of the front end wall 12 of an identical basket 10, as best seen in FIG. 10.

Right left side wall 16 includes an inner panel 82 having a top edge or margin 116 extending therealong. Top edge or margin 116 is substantially level, smooth and uninterrupted except proximate the front end wall 12 and rear end wall 14. Similarly, left side wall 18 includes inner panel 86 which is a mirror image of inner panel 82 and presents a top edge or margin 118 which is substantially smooth, uninterrupted and straight along its length except proximate the front end wall 12 and rear end wall 14. A substantially upright or vertically-extending slot 120 is located proximate the rear end wall 14 at the rear end of top edge or margin 116, while a similar upright or vertically-extending slot 122 is located at the rear end of top edge or margin 118. Slots 120 and 122 are positioned immediately forward of the rearwardmost stacking posts **74*r*, and extend downwardly toward nesting ledge 78. Slots 120 and 122 are only of sufficient width to receive thin web 98 therein and too narrow to receive thick web 96. Thin webs 98 are positioned relative to front end wall 12 and slots 120 and 122 are positioned relative to rear end wall 14, whereby in when two baskets are in a nested configuration, webs 98 interengage slots 120 and 122**.

Located further rearwardly along inner panels 82 and 86, in vertical alignment with the rearwardmost stacking posts **74*r* and thick webs 96, are horizontally-extending notch portions 124 and 126, respectively. Notch portions 124 and 126 are sufficiently wide to receive relatively thick web 96** therein.

The uninterrupted portions of upper edges 116 and 118 terminate at their forward ends in upwardly-extending ramps 128 and 130, respectively. When basket 10 is to be superposed in a stacked orientation on an identical basket, ramps 128 and 130 permit stacking toes 44 and 46 of the upper basket 10 to ramp up and over the stacking lugs 104 and 106 of the upper basket when sliding from the rear, and into engagement with stacking shelves 108 and 110. Located forward of ramps 128 and 130 are relieved portions 132 and 134, respectively. Relieved portions 132 and 134 each include an upper step 136 and a lower step 138. Upper step 136 at its top edge is sufficiently wide to support thin web 98 thereon and at its top edge is at a level corresponding to the lowest portion of notches 124 and 126. Lower step 138 is positioned downwardly of upper step 136 and at its top edge is of approximately the same relative depth as slots 120 and 122. Lower step 138 is at its top edge sufficiently wide to support thick web 96 thereon when two baskets 10 are superposed in a nested orientation.

Additionally, rear end wall 14 includes, when viewed from the front as in FIG. 1, a right nesting wall 140 spaced inboard of right retaining buttress 72, and presenting a nesting shelf 142 adjacent right side wall 16 Similarly, left nesting wall 144 is spaced inboard of retaining buttress 70 and defines a nesting shelf 146 adjacent left side wall 18. Each nesting wall 140 and 144 is spaced inboard from its corresponding retaining buttress a sufficient distance to receive a corresponding stacking toe 46 or 44 of a similarly configured basket 10 when two identical baskets 10 are rotated 180° relative to one another into a nested orientation.

Right side wall 16 and left side wall 18 also preferably include age indicators 150 and 152 molded into respective side walls 16 and 18. Age indicators 150 and 152 advantageously include a plurality of raised, integrally formed indicia 154, each indicia corresponding to a different day of the week.

As shown in FIGS. 2 and 3, the indicia 154 include letters corresponding to the various days of the week arranged in an upper row 156 and a lower row 158. The rows are arranged so that the individual indicia 154 are in vertical registry in a plurality of columns. It is desirable that the lower row of indicia 158 be formed to be out of sequence with the upper row of indicia 156 so that the upper row of indicia 156 can be used to indicate the date of delivery of the baked goods contained within the basket 10, while the lower row of indicia 158 corresponds to the expiration date of such baked goods. A delivery man can use a piece of chalk to strike, using a single stroke, indicia corresponding both the date of delivery and the date of expiration. The user of the baked products within the basket 10 can thus instantly discern when the baked goods were delivered and when their useful life expires, insuring that only fresh products will be dispensed from the baskets hereof. In the event the product remains in the basket beyond the date marked by e.g., a chalk mark made vertically in a column through two rows of indicia, the product remaining within the basket would be discarded as beyond its useful life.

Figure 6:
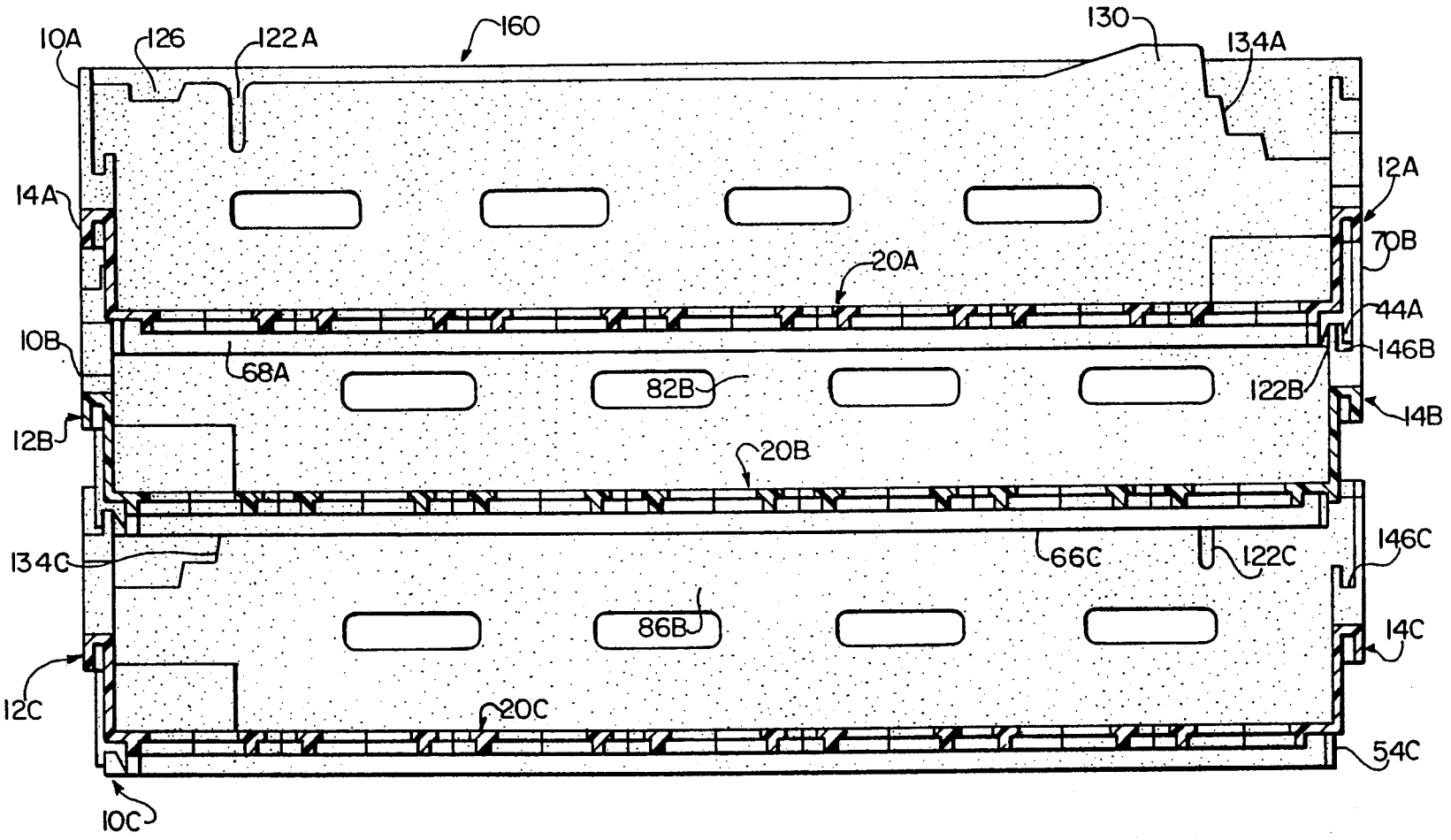
FIG. 6 is a cross-sectional view of three identical multi-level baskets in accordance with the present invention positioned in superposed relationship, the middle basket being shown in stacked orientation at an upper level relative to the lowermost basket, the upper basket being shown positioned in a nested, lower level with respect to the middle basket.

In use, the stacking and nesting capabilities of the basket 10 hereof can best be illustrated by identical baskets 10A, 10B and 10C as shown in FIG. 6. When combined in superposed position, two or more baskets 10A, 10B, and 10C are conventionally referred to as a stack 160. FIG. 6 illustrates such a stack 160 when an upper basket 10A is mounted on an intermediate basket 10B in a nested orientation, while basket 10B is mounted on a lowermost basket 10C in a stacked orientation. The letters "A", "B" and "C" correspond to the particular components of the respective baskets 10A, 10B and 10C.

With respect to the combination of baskets 10A and 10B, basket 10A is identical to basket 10B and thus is provided with lower runners 52 and 54, lower runner 54 being visible in sectional view shown in FIG. 6. In such an orientation, stacking toe 44B is positioned over a nesting shelf 142B of basket 10B and between retaining buttress 70B and nesting wall 140B. Lower runner 54A, extending beneath the remainder of basket 10A, obscures from view the positioning of top edge or margin 118B of right inner panel 82B and also the positioning of stacking posts 74A on nesting ledges 78 of basket 10B. Thus, in the nested orientation, basket 10A is supported on basket 10B by stacking toes 44A and 46A on nesting shelves 124B and 128B, and stacking posts 74A are positioned on nesting ledges 78B. Further, as additional support, ridges 88 and 90, which extend longitudinally front to rear along the side walls 18 and 16, respectively, of each basket, are adapted to rest upon top edges or margins 170 and 172 of right and left outer panels 80 and 82, respectively of two superposed baskets 10A and 10B in a nested orientation.

Basket 10B sets in a stacked orientation with respect to basket 10C, and thus floor 20B is at a higher level relative to floor 20C than floor 20A is to floor 20B when baskets 10A and 10B are in a nested orientation. In this orientation, stacking toes 44B and 46B (not visible) are positioned on stacking shelves 108C and 1110, respectively. In addition, stacking posts 74 are positioned to rest on stacking platforms 92B between outer panel 84B and inner panel 86B. Movement of basket 10B relative to basket 10C in a longitudinal, front-to-rear direction is prevented when the baskets 10B and 10C are nested or stacked by positioning of stacking lugs 104 and 106 in gap 174 or 176 between stacking toe 44 and lower runner 54 or alternately stacking toe 46 and lower runner 52.

Finally, as can be seen in FIG. 6, lower runner 54C, together with lower runner 52C (not shown), and registry legs 36C, 38C, 40C, and 42C (also not shown) support the entire stack 156, protecting the various stacking posts, stacking lugs, stacking toes and the like from damage or wear in the event the stack 160 were to be skidded or moved across a supporting surface. Thus, when a supporting surface is a substantially planer, horizontally extending surface, lower runners 52C and 54C and registry legs 36C, 38C, 40C, and 42C serve to support the entire stack and no other components of the stack engage the supporting surface.

After the supply of baked product within the basket has been depleted, it may be desirable to orient the baskets into a storage position. In this storage orientation, the various baskets 10 are placed at 90° angles relative to one another, so that left side walls 18 or right side walls 16 extends beyond front end wall 12 or rear end wall 1 4 of the next lowermost basket 10. In such a storage orientation, cornices 30 or 62 of front and rear end walls 12 and 14, respectively, can be located in recesses 56, 58, 112, and 114 of the next uppermost basket 10. The next uppermost basket 10 is thereby prevented from transverse shifting, while buttresses 70 and 72 and outboard portions 138 and 140 prevent movement of the next uppermost baskets therebetween in a side-to-side direction relative to the next lowermost basket. Yet further, teeth 26 are selectively spaced along cornices 30 and 62 to fit within openings 24 and thus serve as a further safeguard against undesired shifting of the uppermost basket 10 relative to the next lower basket 10 when combined in a storage orientation.

Figure 7:
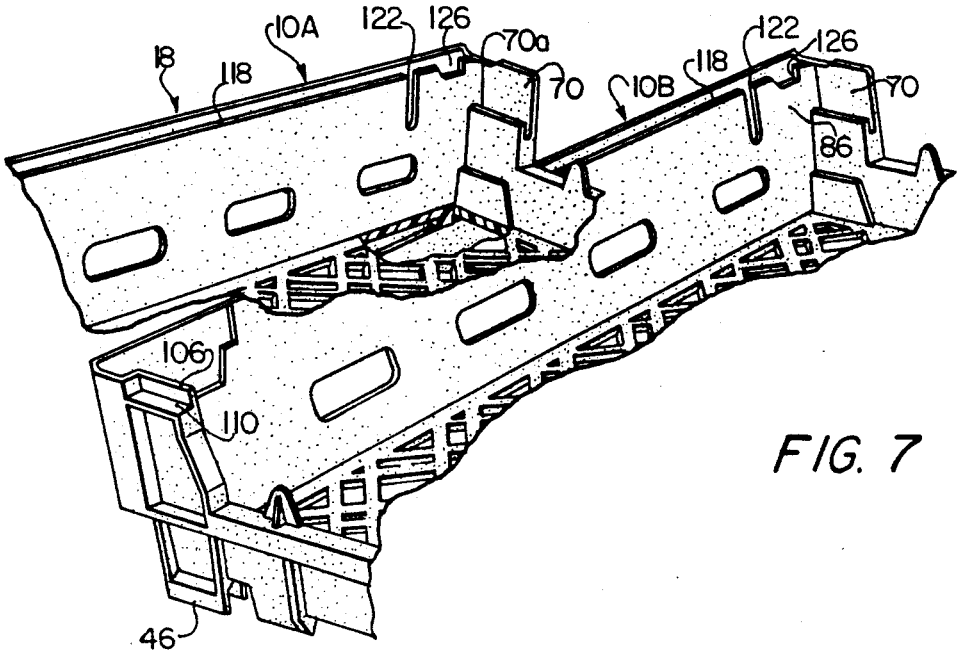
FIG. 7 is a fragmentary perspective view of two multi-level baskets in accordance with the present invention, being positioned for stacking engagement.
Figure 8:
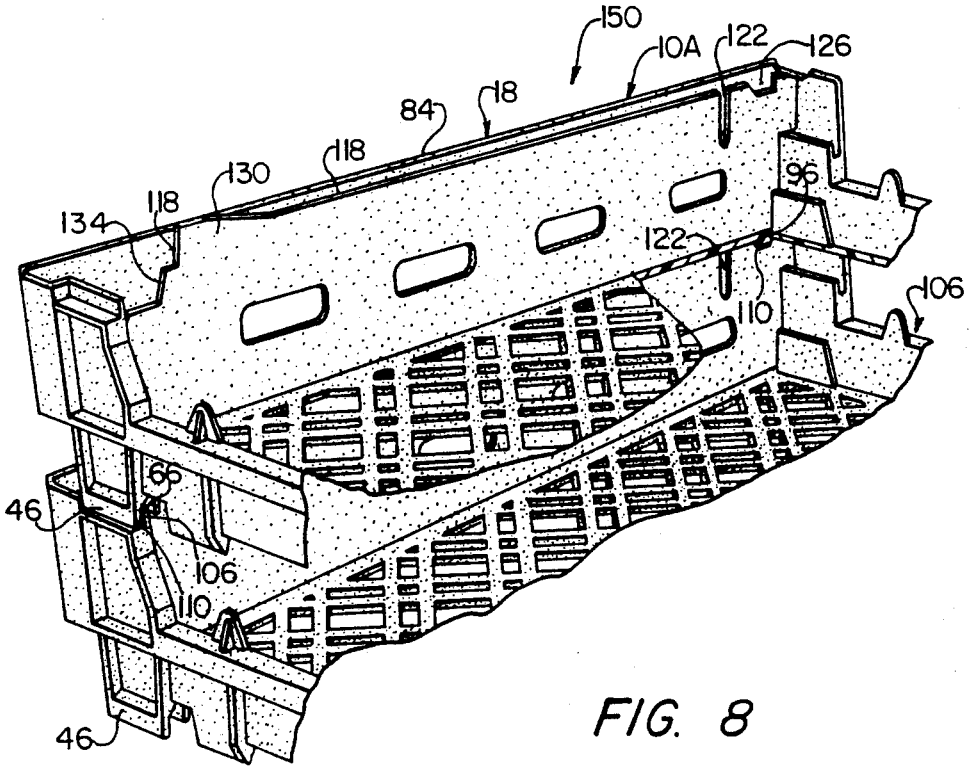
FIG. 8 is a fragmentary perspective view of two multi-level baskets similar to FIG. 7, but with the upper basket fully advanced along the upper slideway or rail of the lower basket and aligned in a stacked, superposed relationship.

The slide-on feature of the present baskets is particularly illustrated in FIGS. 7 through 10. Turning now to FIGS. 7 and 8, an uppermost basket 10A is shown in position for sliding along top edge or margin 116 of inner panel 86 of a basket 10B therebelow. As can be seen in FIG. 7, the relatively thick web 96 is located for sliding along top edge or margin 116, top edge or margin 116 thus constituting a slideway or rail. Thick web 96 is sufficiently wide to move over and across slot 120 of basket 10B, whereby thick web 96 bridges the gap of the relatively thin slot 120. After moving over slot 120, thick web 96 locates in notch 110, as shown in FIG. 8.

Thereafter, basket 10A can drop into a stacked position as shown in FIG. 8, with stacking toe 46 supported by ridges 88 and 90 of basket 10B, thin web 98 of basket 10A supported on upper step 136 of relieved portion 116 of basket 10B, and stacking posts 74 of basket 10A supported by stacking posts 74 of the next lower basket 10B. As can be seen, top edge or margin 116 extends the majority of the distance between front end wall 12 and rear end wall 14 whereby upper basket 10A can slide almost the entire distance therebetween until it lodges in its final, stacked superposed position. It is to be understood that because side walls 16 and 18 are mirror images of one another, movement of the upper basket 10A along right side wall 16 would be the same as movement along left side wall 18 of the next lower basket 10B.

Turning now to FIGS. 9 and 10, a pair of identical baskets 10A and 10B are shown rotated 180° relative to one another so that basket 10A can slide onto basket 10B into a nested orientation. As can be seen from FIG. 9, thin web 98 is positioned for sliding alongtop edge or margin 116 of left inner panel 86. Relatively thin web 98 is supported by and can glide along a slideway or rail defined by top edge or margin 116 in a rearward direction relative to basket 10B until it engages slot 120 of basket 10B. Upon moving into engagement with slot 120, relatively thin web 98 is sufficiently thin to enter slot 120. Upon engaging slot 120, thin web 98 of basket 10A is able to shift generally downwardly therein, enabling basket 10A to drop down into a nested orientation on basket 10B, as shown in FIG. 10.

When thin web 98 reaches slot 120, basket 10A drops downwardly With lower runner 54 inboard of nesting wall 102 and stacking toe 44 positioned between nesting wall 144 and retaining buttress 70 to enter nesting shelf 146. The relatively thick web 96 of basket 10A moves downwardly onto lower step 138 of relieved portion 134 of basket 10B, and stacking posts 74 of upper basket 10A rest on and are supported by stacking platforms 92 of basket 10B. Finally, nesting ledges 78 are supported on outer panels 84 and 80, respectively.

Thus, it may be understood that the user of a basket 10 can stack a plurality of identical baskets easily by placing one basket 10 on top of another basket 10. Even with the uppermost basket 10A overlapping the lower basket 10B only slightly, the user can slide the uppermost basket 10A rearwardly onto the next lower basket 10B so that they are either nested or stacked, according to the desires of the user. Identical baskets 10A and 10B are thus complimentarily configured to enable a user to quickly and easily erect a stack 160 of multiple, identical baskets 10 without the need for placing the baskets in superposed relationship prior to dropping the upper basket into the desired nested or stacked orientation.

It is to be further understood that various modifications of the present invention can be made according to the needs of the particular circumstance. For example, holes can be drilled in inner panels 82 and 86 to permit drainage of water during a washing cycle. Such drain holes would desirably be formed or drilled adjacent stacking posts 74 so that maximum drainage could be achieved. In addition, various reinforcing ribs can be added as desired according to the environment of use and the desired life span of the basket 10 in accordance with the invention hereof.

It is therefore to be understood that, within the scope of the appended claims and their equivalents, the invention can be practiced otherwise than as specifically described.

What is claimed is:

1. A container adapted to have, in association with another identical container, a high stacking configuration, a low stacking configuration, and a nesting configuration, said container comprising:

a pair of opposed left and right side walls, a pair of opposed front and rear end walls, and a floor, and a plane of symmetry vertical to said floor and parallel to said left an right side walls, and equidistant from said left and right side walls;

said left and right side walls being mirror images of each other and each having:

a substantially vertical outer panel having parallel top and bottom edges, said bottom edge being offset from said floor;

a substantially vertical inner panel having parallel top and bottom edges, said bottom edge conjoining said floor;

a plurality of spaced-apart horizontal platforms formed between said inner and outer panels;

a horizontal ridge connecting said bottom edge of said outer panel with said inner panel, said ridge being formed between said platforms and defining a plurality of horizontal ledges alternating with said platforms, said platforms being narrower than said ledges, and therebeing a ledge formed immediately adjacent said front end wall and a platform formed immediately adjacent said rear end wall; and a plurality of stacking posts extending downwardly from said ridge in vertical alignment with said plurality of platforms, said stacking posts being parallel to and offset form said inner panel, and said stacking posts and said platforms having substantially equal widths, whereby said stacking post of the upper container will fit over the outer surface of each said horizontal ledge of the lower container such that said stacking posts and said horizontal edges cooperate to limit any outward flexing of the end walls of the lower container;

said top edge of each said inner panel being positioned above said platforms;

said front and rear end walls having opposed lower walls portions having a height lower than said ledges, said front end wall having first upwardly-extending members at either end thereof and said rear end wall having second upwardly-extending members at either end thereof, said first upwardly-extending members, said second upwardly-extending members, and said lower wall portions being separated by equal distances; and wherein each of said left and right side walls further has a rearward vertical web connecting one of said stacking posts to said inner panel and wherein said inner panel has a horizontally-extending notch formed therein extending downwardly from said top edge thereof in vertical alignment with said vertical web and of sufficient weight to receive said web, whereby in said high stacking configuration, said rearward vertical web interengages said horizontally-extending notch.

2. The container of claim 1, wherein said notch is formed in said inner panel above said platform adjacent said rear end wall.

3. A container adapted to have, in association with another identical container, a high stacking configuration, a low stacking configuration, and a nesting configuration, said container comprising:

a pair of opposed left and right side walls, a pair of opposed front and rear end walls, and a floor, and a plane of symmetry vertical to said floor and parallel to said left and right side walls, and equidistant from said left and right side walls;

said left and right side walls being mirror images of each other and each having;

a substantially vertical outer panel having parallel top and bottom edges, said bottom edge being offset from said floor;

a substantially vertical inner panel having parallel top and bottom edges, said bottom edge conjoining said floor;

a plurality of spaced-apart horizontal platforms formed between said inner and outer panels;

a horizontal ridge connecting said bottom edge of said outer panel with said inner panel, said ridge being formed between said platforms and defining a plurality of horizontal ledges alternating with said platforms, said platforms being narrower than said ledges, and therebeing a ledge formed immediately adjacent said front end wall and a platform formed immediately adjacent said rear end wall; and a plurality of staking posts extending downwardly from said ridge in vertical alignment with said plurality of platform said stacking posts being parallel to and offset from said inner panel, and said tacking posts and said platforms having substantially equal widths, whereby said stacking posts of the upper container will fit over the outer surface of each said horizontal ledge of the lower container such that said stacking posts and said horizontal ledges cooperate to limit any outward flexing of the end walls of the lower container;

said top edge of each said inner panel being positioned above said platforms;

said front and rear end walls having opposed lower wall portions having a height lower than said ledges, said front end wall having first upwardly-extending members at either end thereof and said rear end wall having second upwardly-extending members at either end thereof, said first upwardly-extending members, said second upwardly-extending members, and said lower wall portions being separated by equal distances; and wherein each of said left and right side walls further has a forward vertical web connecting one of said stacking posts to said inner panel, and wherein said inner panel has a vertically-extending slot formed therein extending downwardly from said top edge thereof and of sufficient width to receive said web, said web being positioned relative to said front ed wall and said slot being positioned relative to said rear end wall whereby in said low stacking configuration, said forward vertical web interengages said vertically extending slot.

4. The container of claim 3, wherein said slot is formed in said inner panel adjacent said platform adjacent said rear end wall.

5. A container adapted to have, in association with another identical container, a high stacking configuration, a low stacking configuration, and a nesting configuration, said container comprising:

a pair of opposed left and right side walls, a pair of opposed front and rear end walls, and a floor, and a plane of symmetry vertical to said floor and parallel to said left and right side wall said equidistant from said left and right side walls;

said left and right side walls being mirror images of each other and each having;

a substantially vertical outer panel having parallel top and bottom edges, said bottom edge being offset from said floor;

a substantially vertical inner panel having parallel top and bottom edges, said bottom edge conjoining said floor;

a plurality of spaced-apart horizontal platforms formed between said inner and outer panels;

a horizontal ridge connecting said bottom edge of said outer panel with said inner panel, said ridge being formed between said platforms and defining a plurality of horizontal ledges alternating with said platforms, aid platforms being narrower than said ledges, and there being a ledge formed immediately adjacent said front end wall and a platform formed immediately adjacent said rear end wall; and a plurality of stacking posts extending downwardly from said ridge in vertical alignment with said plurality of platforms, said stacking posts being parallel to and offset from said inner panel, and said stacking posts and said platforms having substantially equal weights, whereby said stacking posts of the upper container will fit over the outer surface of each said horizontal ledge of the lower container such that said stacking posts and said horizontal ledges cooperate to limit any outward flexing of the end walls of the lower container;

said top edge of each said inner panel being positioned above said platforms;

said front and rear end walls having opposed lower wall portions having a height lower than said ledges, said front end wall having first upwardly-extending members at either end thereof and said rear ned wall having second upwardly-extending members at either end thereof, said first upwardly-extending members, said second upwardly-extending members, and said lower wall portions being separated by equal distances; and wherein each of said left and right side walls further has a rearward vertical web connecting a first of said stacking posts to said inner panel and a forward vertical web connecting a second of said stacking posts to said inner panel, and wherein said inner panel has both a horizontally-extending notch and a vertically-extending slot formed therein extending downwardly form said top edge thereof, said notch being in vertical alignment with said rearward vertical web, and said forward vertical web being positioned relative to said front end wall and said slot being positioned relative to said rear end wall whereby in said low stacking configuration, said forward vertical web interengages said vertically extending slot.

6. The container of claim 5, wherein said top edge of each said inner panel includes an upwardly angled ramp portion substantially in alignment with said platform closest to said front end wall, said top edge being uninterrupted between said ramp and said slot to define a rail for sliding engagement with said forward and rearward vertical webs.

7. The container of claim 6, further including left and right lower runners extending longitudinally from said left and right side walls from front to rear, parallel to said left and right side walls; and wherein said rear end wall includes at its ends left and right retaining buttresses, each of said buttresses including in it supper edge a transversely-extending notch, said notches providing a sliding surface for said lower runners.

8. A container adapted to have, in association with another identical container, a high stacking configuration, a low stacking configuration, and a nesting configuration, said container comprising:

a pair of opposed left and right side walls, a pair of opposed front and rear ned walls, and a floor, and plane of symmetry vertical to said floor and parallel to said left and right side walls, and equidistant form said left and right side walls;

said left and right side walls being mirror images of each other and each having:

a substantially vertical outer panel having parallel top and bottom edges, said bottom edge being offset from said floor;

a substantially vertical inner panel having parallel top and bottom edges, said bottom edge conjoining said floor;

a plurality of spaced-apart horizontal platforms formed between said inner and outer panels;

a horizontal ridge connecting said bottom edge of said outer panel with said inner panel, said ridge being formed between said platforms and defining a plurality of horizontal ledges alternating with said platforms, said platforms being narrower than said ledges, and therein being a ledge formed immediately adjacent said front end wall and a platform formed immediately adjacent said rear end wall; and a plurality of stacking posts extending downwardly from said ridge in vertical alignment with said plurality of platforms, said stacking posts being parallel to and offset from said inner panel, and said stacking posts and said platforms having substantially equal widths, whereby said stacking posts of the upper container will fit over the outer surface of each said horizontal lee of the lower container such that said stacking posts and said horizontal ledges cooperate to limit any outward flexing of the end walls of the lower container;

said top edge of each said inner panel being positioned above said platforms;

said front and rear end walls having opposed lower wall portions having a height lower than said ledges, said front end wall having first upwardly-extending members at either end thereof and said rear end wall having second upwardly-extending members at either end thereof, said first upwardly-extending members, said second upwardly-extending members, and said lower wall portions being separated by equal distances; and wherein each of said first upwardly-extending members includes a stacking shelf at the top thereof, each of said second upwardly-extending members includes a nesting channel formed therein, said nesting channels are opposite said stacking shelves, and said front end wall includes a pair of projections extending downwardly therefrom in vertical alignment with said stacking shelves.

9. The container of claim 8, wherein each of said stacking shelves includes a stacking lug extending upwardly therefrom; and wherein said top edge of each said inner panel includes an upwardly angled ramp portion, whereby when said container is superposed in the high stacking configuration over said another identical container, said ramp portions permit said projections of said superposed container to ramp up and over said stacking lugs of said another identical container when sliding form the rear, and into engagement with said stacking shelves.

10. A container adapted to have, in association with another identical container, a high stacking configuration, a low stacking configuration, and a nesting configuration, said container comprising:

a pair of opposed left and right side walls, a pair of opposed front and rear end walls, and a floor, and a plane of symmetry vertical to said floor and parallel to said left an right side walls, and equidistant from said left and right side walls;

said left and right side walls being mirror images of each other and each having:

a substantially vertical outer panel having parallel top and bottom edges, said bottom edge being offset from said floor;

a substantially vertical inner panel having parallel top and bottom edges, said bottom edge conjoining said floor;

a plurality of spaced-apart horizontal platforms formed between said inner and outer panels;

a horizontal ridge connecting said bottom edge of said outer panel with said inner panel, said ridge being formed between said platforms and defining a plurality of horizontal ledges alternating with said platforms, said platforms being narrower than said ledges, and there being a ledge formed immediately adjacent said front end wall and a platform formed immediately adjacent said rear end wall; and a plurality of stacking posts extending downwardly from said ridge in vertical alignment with said plurality of platforms, said stacking posts being parallel to and offset form said inner panel, and said stacking posts and said platforms having substantially equal widths, whereby said stacking posts of the upper container will fit over the outer surface of each said horizontal ledge of the lower container such that said stacking posts and said horizontal ledges cooperate to limit any outward flexing of the end walls of the lower container;

said top edge of each said inner panel being positioned above said platforms;

said front and rear end walls having opposed lower wall portions having a height lower than said ledges, said front end wall having first upwardly-extending members at either end thereof and said rear end wall having second upwardly-extending members at either end thereof, said first upwardly-extending members, said second upwardly-extending members, and said lower wall portions being separated by equal distances;

wherein said lower wall portion of said front end wall includes a cornice formed at the top thereof extending between said first upwardly-extending members and a pair of spaced-apart recesses formed at the bottom thereof, said lower wall portion of said rear end wall includes a cornice formed at the top thereof extending between said second upwardly-extending members and a pair of spaced-apart recesses formed at the bottom thereof; and wherein said recesses in said front end wall, said recesses in said rear ned wall, and said cornices having substantially equal widths and are separated by equal distances.

11. A container adapted to have, in association with another identical container, a high stacking configuration and a low stacking configuration, said container comprising:

a pair of opposed left and right side walls, a pair of opposed front an rear end walls, and a floor, and a plane of symmetry vertical to said floor and parallel to said left and right side walls, and equidistant from said left and right side walls;

said left and right side walls being mirror images of each other and each having;

a substantially planar outer panel having parallel top and bottom edges, said bottom edge being offset from said floor;

a substantially planar inner panel having parallel top and bottom edges, said bottom edge conjoining said floor;

a plurality of spaced-apart horizontal platforms formed between said inner and outer panels;

a horizontal ridge connecting said bottom edge of said outer panel with said inner panel, said ridge being formed between said platforms and defining a plurality of horizontal ledges alternating with said platforms, said platforms being narrower than said ledges, and there being a ledge formed immediately adjacent said front end wall and a platform formed immediately adjacent said rear end wall; and a plurality of stacking posts extending downwardly from said ridge in vertical alignment with said plurality of platforms, said stacking posts being parallel to and offset form said inner panel, and said stacking posts and said platforms having substantially equal widths, whereby said stacking posts of the upper container will fit over the outer surface of each said horizontal ledge of the lower container such that said stacking posts and said horizontal ledges cooperate to limit any outward flexing of the end walls of the lower container;

said top edge each said inner panel being positioned above said platforms and no higher than said top edge of said outer panel along at least most of its length;

said front and rear ned walls having opposed lower wall portions having a height lower than said ledges; and wherein each of said left and right side walls further has a rearward vertical web connecting one of said stacking posts to said inner panel and wherein said inner panel has a horizontally-extending notch formed therein extending downwardly from said top edge thereof in vertical alignment with said vertical web and of sufficient weight to receive said web, whereby in said high sacking configuration, said rearward vertical web interengages said horizontally-extending notch.

12. The container of claim 11, wherein said notch is formed in said inner panel above said platform adjacent said rear end wall.

13. A container adapted to have, in association with another identical container, a high stacking configuration and a low stacking configuration, said container comprising:

a pair of opposed left and right side walls, a pair of opposed front and rear end walls, an a floor, and a plane of symmetry vertical to said floor and parallel to said left and right side walls, and equidistant form said left and right side walls;

said left and right side walls being mirror images of each other and each having:

a substantially planar outer panel having parallel top and bottom edges, said bottom edge being offset from said floor;

a substantially planar inner panel having parallel top and bottom edges, said bottom edge conjoining said floor;

a plurality of spaced-apart horizontal platforms formed between said inner and outer panels;

a horizontal ridge connecting said bottom edge of said outer panel with said inner panel, said ridge being formed between said platforms and defining a plurality of horizontal ledges alternating with said platforms, said platforms being narrower than said ledges ,an there being a ledge formed immediately adjacent said front end wall and a platform formed immediately adjacent sad rear end wall; and a plurality of stacking posts extending downwardly form said ridge in vertical alignment with said plurality of platforms, said stacking posts being parallel to and offset form said inner panel, and said stacking posts and said platforms having substantially equal widths, whereby said stacking posts of the upper container will fit over the outer surface of each said horizontal ledge of the lower container such that said stacking posts and said horizontal ledges cooperate to limit any outward flexing of the end walls of the lower container; .

said top edge each said inner panel being positioned above said platforms and no higher than said top edge of said outer panel along at least most of its length;

said front and rear nd walls having opposed lower wall portions having a height lower than said ledges; and wherein each of said left and right side walls further has a forward vertical web connecting one of said stacking posts to said inner panel, and wherein said inner panel has a vertically-extending slot formed therein extending downwardly form id top edge thereof an of sufficient width to receive said web, said web being positioned relative to said front end wall and said slot being positioned relative to said rear end wall whereby in said low sacking configuration, said forward vertical web interengages said vertically extending slot.

14. The container of claim 13, wherein said slot is formed in said inner panel adjacent said platform adjacent said rear end wall.

15. A container adapted to have, in association with another identical container, a high stacking configuration and a low stacking configuration, said container comprising:

a pair of opposed left and right side walls, a pair of opposed front and rear ed walls, and a floor, and a plane of symmetry vertical to said floor and parallel to said left and right side walls, and equidistant from said left and right side walls;

said left and right side walls being mirror images of each other and each having:

a substantially planar outer panel having parallel top and bottom edges, said bottom edge being offset form said floor;

a substantially planar inner panel having parallel top and bottom edges, said bottom edge conjoining said floor;

a plurality of spaced-apart horizontal platforms formed between said inner and outer panels;

a horizontal ridge connecting said bottom edge of said outer panel with said inner panel, said ridge being formed between said platforms and defining a plurality of horizontal ledges alternating with said platforms, said platforms being narrower than said ledges, an there being a ledge formed immediately adjacent said front end wall and a platform formed immediately adjacent said rear end wall; and a plurality of stacking posts extending downwardly form said ridge in vertical alignment with said plurality of platforms, said stacking posts being parallel to and offset from said inner panel, and said stacking posts and said platforms having substantially equal widths, whereby said stacking posts of the upper container will fit over the outer surface of each said horizontal ledge of the lower container such that said stacking posts and said horizontal ledges cooperate to limit any outward flexing of the end walls of the lower container;

said top edge each said inner panel being positioned above said platforms and no higher than said top edge of said outer panel along at least most of its length; 'said front and rear end walls having opposed lower wall portions having a height lower than said ledges; and wherein each of said left and right side walls further has a rearward vertical web connecting a first of said spacing posts to said inner panel and a forward vertical web connecting a second of said stacking posts to said inner panel, and wherein said inner panel has both a horizontally-extending notch and a vertically-extending slot formed therein extending downwardly form said top edge thereof, said notch being in vertical alignment with said rearward vertical web, and said forward vertical web being positioned relative to said front end wall and said slot being positioned relative to said rear end wall whereby in said low stacking configuration, said forward vertical web interengages said vertically extending slot.

16. The container of claim 15, wherein said top edge of each said inner panel includes an upwardly angled ramp portion substantially in alignment with said platform closest to said front end wall, said top edge being uninterrupted between said ramp and said slot to define a rail for sliding engagement with said forward and rearward vertical webs.

17. The container of claim 16, further including left and right lower runners extending longitudinally from said left and right side walls form front to rear, parallel to said left and right side walls; and wherein said rear end wall include at its end left and right retainer buttresses, each of said buttresses including in its upper edge a transversely-extending notch, said notch providing a sliding surface for said lower runners.

18. A container adapted to have, in association with another identical container, a high stacking configuration and a low stacking configuration, said container comprising:

a pair of opposed left and right side walls, a pair of opposed front and rear end walls, and a floor, and a plane of symmetry vertical to said floor and parallel to said left and right side walls, and equidistant from said left and right side walls;

said left and right side walls being mirror images of each other and each having:

a substantially planar outer panel having parallel top and bottom edges, said bottom edge being offset from said floor;

a substantially planar inner plan having parallel top and bottom edges, said bottom edge conjoining said floor;

a plurality of spaced-apart horizontal platforms formed between said inner and outer panels;

a horizontal ridge connecting said bottom edge of said outer panel with said inner panel, said ridge being formed between said platforms and defining a plurality of horizontal ledges alternating with said platforms, said platforms begin narrower than said ledges, an there being a ledge formed immediately adjacent said front end wall and a platform formed immediately adjacent said rear end wall; and a plurality of stacking posts extending downwardly from said ridge in vertical alignment with said plurality of platforms, said stacking posts being parallel to and offset from said inner panel, and said stacking posts and said platforms having substantially equal widths, whereby said stacking posts of the upper container will fit over the outer surface of each said horizontal ledge of the lower container such that said stacking posts and said horizontal ledges cooperate to limit any outward flexing of the end walls of the lower container;

said top edge each said inner panel being positioned above said platforms and no higher than said top edge of said outer panel along at least most of its length;

said front and rear ned walls having opposed lower wall portions having a height lower than said ledges; and wherein each of said first upwardly-extending members includes a stacking shelf at the top thereof, each of said second upwardly-extending members includes a nesting channel formed therein, said nesting channels are opposite said stacking shelves, and said front end wall includes a pair of projections extending downwardly therefrom in vertical alignment with said stacking shelves.

19. The container of claim 18, wherein each of said stacking shelves includes a stacking lug extending upwardly therefrom; and wherein said top edge of each said inner panel includes an upwardly angled ramp portion, whereby when one said container is superposed in the high stacking configuration over said another identical container, said ramp portions permit said projections of said superposed container to ramp up and over said stacking lugs of said another identical container when sliding from the rear, and into engagement with said stacking shelves.

20. A container adapted to have, in association with another identical container, a high stacking configuration and a low stacking configuration, said container comprising:

a pair of opposed left and right side walls, a pair of opposed front and rear end walls, and a floor, and a plane of symmetry vertical to said floor and parallel to said left and right side walls, and equidistant from said left and right side walls;

said left and right side walls being mirror images of each other and each having:

a substantially planar outer panel having parallel top and bottom edges, said bottom edge being offset from said floor;

a substantially planar inner panel having parallel top and bottom edges, said bottom edge conjoining said floor;

a plurality of spaced-apart horizontal platforms formed between said inner and outer panels;

a horizontal ridge connecting said bottom edge of said outer panel with said inner panel, said ridge being formed between said platforms and defining a plurality of horizontal ledges alternating with said platforms, said platforms being narrower than said ledges, and therebeing a ledge formed immediately adjacent said front end wall and a platform formed immediately adjacent said rear end wall; and a plurality of stacking posts extending downwardly form said ridge in vertical alignment with said plurality of platforms, said stacking posts being parallel to and offset form said inner panel, and said stacking posts and said platforms having substantially equal widths, whereby said stacking posts of the upper container will fit over the outer surface of each said horizontal ledge of the lower container such that said stacking posts and said horizontal ledges cooperate to limit any outward flexing of the end walls of the lower container;

said top edge each said inner panel being positioned above said platforms and no higher than said top edge of said outer panel along at least most of its length;

said front and rear end walls having opposed lower wall portions having a height lower than said ledges;

wherein said lower wall portion of said front end wall includes a cornice formed at the top thereof extending between said first upwardly-extending members and a pair of spaced-apart recesses formed at the bottom thereof, said lower wall portion of said rear end wall includes a cornice formed at the top thereof extending between said second upwardly-extending members and a pair of spaced-apart recesses formed at the bottom thereof; and wherein said recesses in said front end wall, said recesses in said rear end wall, and said cornices have substantially equal widths and are separated by equal distances.

* * * * *